US006158486A

United States Patent [19]

Olson et al.

[11] Patent Number: 6,158,486

[45] Date of Patent: Dec. 12, 2000

[54] CLOSED PACKAGE LIQUID DISPENSING SYSTEM

[75] Inventors: Scott R. Olson, Mahtomedi; Keith D. Johnson, Woodbury, both of Minn.; Lynne A. Olson, Ellsworth, Wis.

[73] Assignee: Ecolab Inc., St. Paul, Minn.

[21] Appl. No.: 09/196,265

[22] Filed: Nov. 19, 1998

[51] Int. Cl.[7] ..... B67D 1/00

[52] U.S. Cl. ..... 141/351; 222/325

[58] Field of Search ..... 222/325, 466; 141/351; 68/17 R

[56] References Cited

U.S. PATENT DOCUMENTS

| | | | |
|---|---|---|---|
| 4,328,909 | 5/1982 | Jeans | 222/54 |
| 4,408,701 | 10/1983 | Jeans . | |
| 4,564,132 | 1/1986 | Lloyd-Davies | 222/522 |
| 4,570,830 | 2/1986 | Jeans | 222/185 |
| 5,259,423 | 11/1993 | Simmel et al. | 141/1 |
| 5,273,083 | 12/1993 | Burrows | 141/18 |
| 5,425,404 | 6/1995 | Dyer | 141/351 |
| 5,462,189 | 10/1995 | Pierce | 220/254 |
| 5,542,555 | 8/1996 | Hidding et al. | 215/265 |
| 5,597,019 | 1/1997 | Thomas et al. | 141/18 |
| 5,598,877 | 2/1997 | Reidel | 141/346 |

*Primary Examiner*—Philippe Derakshani
*Attorney, Agent, or Firm*—Mau & Krull, P.A.

[57] ABSTRACT

A liquid dispensing apparatus (10) includes a container (70) for holding a liquid product to be dispensed. A docking station (20) receives the container (70). A reservoir tank (50) is positioned in the docking station (20) for receiving the liquid to be dispensed. A docking cup is connected to the docking station for opening a bottle insert (90) which is contained in the container (70). By use of the present invention, contact with the product to be dispensed is reduced as is chemical odor. The lockout feature prevents the wrong product from being dispensed. The product, independent of the viscosity, may be completely emptied from the package.

6 Claims, 10 Drawing Sheets

CLOSED PACKAGE LIQUID DISPENSING SYSTEM

BACKGROUND OF THE INVENTION

1. Field of the Invention

This invention relates generally to a closed package liquid dispensing system and more particularly to a liquid product dispenser including a resealable package, easy to handle containers that can be dispensed to a reservoir.

2. Description of the Prior Art

Many systems have been developed for dispensing a liquid product to an end use such as laundry machines. A goal of a dispensing system is that it be user friendly. That is, the product to be dispensed should be an easy to handle containers, the product can be safely dispensed and provide for various safety features. These features may include a lockout system to make certain that the right product is being dispensed and also an alarm to indicate when the product container is empty. A number of systems have been developed for delivering liquid laundry products, but have fallen short in one or more desired areas. While the present invention is described with respect to the dispensing of liquid laundry products, it is a system that has been designed for broader usage wherever concentrated and potentially corrosive liquid products are handled.

Most of the laundry dispensing systems designed to date have the liquid concentrate go directly from the bottle in which the liquid concentrate is contained to the laundry machine. A solid block product dispenser will often include an intermediate reservoir, which lends itself to additional advantages, such as the ability to utilize a low-level alarm and a full visual indicator.

The present invention addresses the features desired in a liquid dispensing system.

SUMMARY OF THE INVENTION

The present invention is a liquid dispensing apparatus having a container for holding a liquid product to be dispensed. The container has an outlet at a first end and the container has a second end. A docking station is provided for receiving the container. The docking station has a support for holding the container. A reservoir tank is located beneath the container and receives the liquid product from the container. The reservoir has an inlet and an outlet. A docking cup is operatively connected to the docking station. The docking cup has an inlet adapted to receive the outlet of the container, and the docking cup has an outlet operatively connected to the inlet of the reservoir. The container has a first handle position proximate the first end for initial handling of the container and a second handle position proximate the second end for handling the container while it is inserted in the docking station.

In another embodiment, the invention is a liquid dispensing apparatus having a container for holding a liquid product to be dispensed. The container, has an outlet at a first end and the container has a second end. A docking station is provided for receiving the container. The docking station has a support for holding the container. A reservoir tank is positioned below the container for receiving liquid product from the container. The reservoir has an outlet and an inlet. A docking cup is operatively connected to the docking station. The docking cup has an inlet adapted to receive the outlet of the container, and the docking cup has an outlet operatively connected to the inlet of the reservoir. A container insert is operatively connected to the outlet of the container. The insert includes a first outer member configured to fit in the outlet of the container. A second inner member has a central bore. The bore has an opening al its first end. The second member is operatively connected to the first member. A slidable member is configured to slide in the bore. The slidable member is movable between a closed position and a dispensing position. A spring is positioned between the slidable member and the second member, urging the slidable member to a closed position. The second member has an aperture. The sliding member sealing the aperture when in the closed position and uncovering the aperture in the dispensing position, wherein product may flow between the first and second members, through the aperture and to the bore to the outlet of the docking cup.

In another embodiment, the invention is a container for holding a liquid product to be dispensed. The container is for use with a dispensing apparatus having a docking station which has a docking cup and lockout indentation proximate the docking cup. The container includes an outer shell defining an inner cavity. The shell has a first end and a second end. An outlet is positioned proximate the first end. The outlet is in fluid communication with the cavity. A first handle is positioned proximate the first end for initial handling of the container and a second handle is positioned proximate the second end for handling the container while being inserted into a docking station. In a preferred embodiment, the container includes a lockout section formed proximate the outlet of the container for mating with a lockout indentation in the docking station.

DETAILED DESCRIPTION OF THE PREFERRED EMBODIMENT

Figure 1:
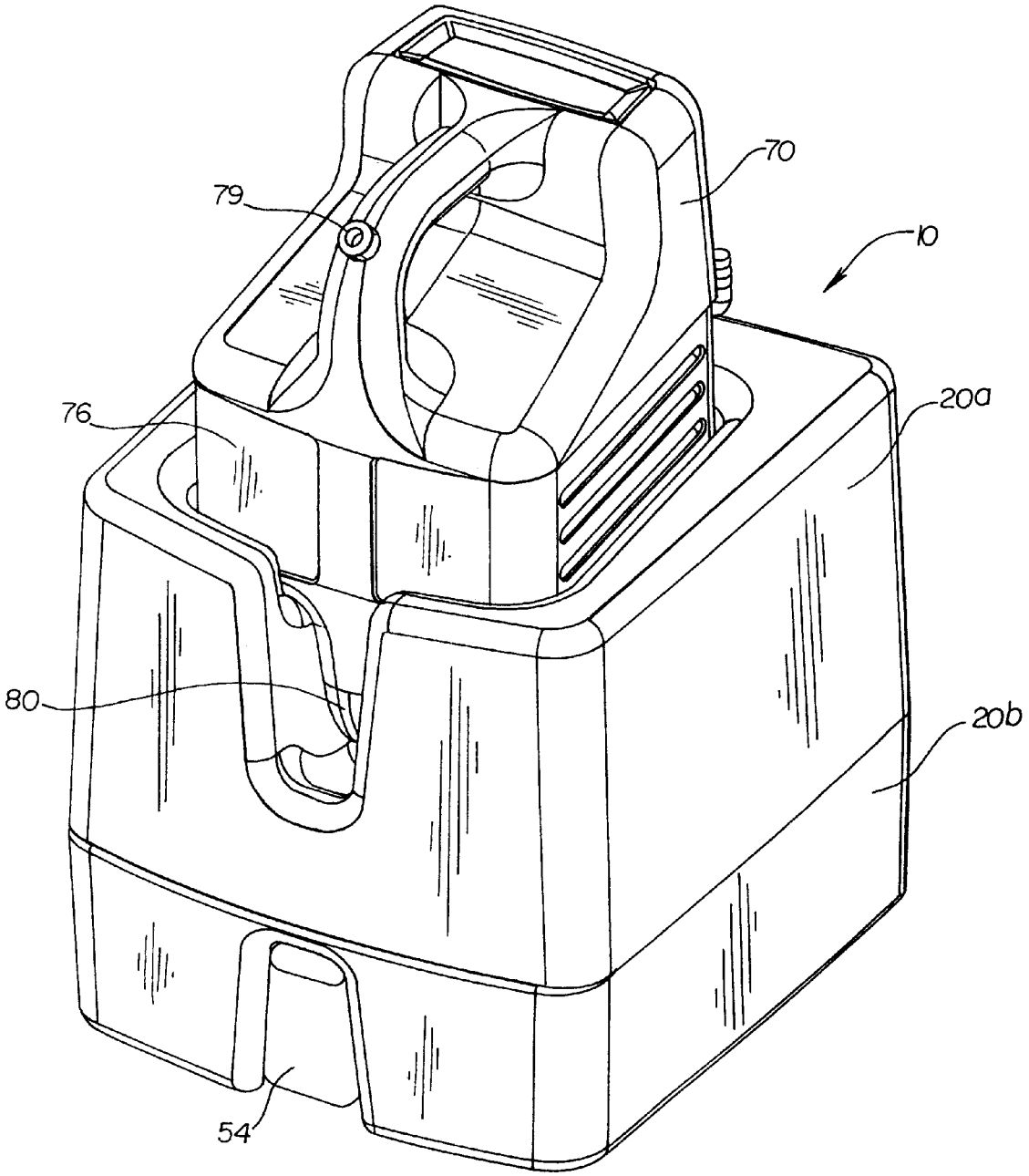
FIG. 1 is a perspective view showing the dispensing system of the present invention.

Referring to the drawings, wherein like numerals represent like parts throughout the several views, there is generally shown at 10 a liquid dispensing system. The liquid dispensing system 10 includes a docking station 20 that has a docking, cup 30 mounted therein. A reservoir tank 50 has its inlet 51 in fluid communication with the docking cup 30. The docking station 20 has a cavity 21 which is sized and configured, as will be discussed more fully hereafter, to receive the container 70.

The reservoir tank 50 has a top 50*a* and bottom 50*b* connected by a side wall 50*c* to generally form a reservoir tank 50 which has an inner cavity to receive liquid product to be dispensed. The reservoir tank 50 has a threaded inlet 51 formed in the top 50*a*. Two feet 52 are formed in the bottom 50*b* and extend generally perpendicular to the longitudinal axis of the reservoir tank 50. An outlet 53 has a barbed end 53*a* to which a pickup line 11 is attached with a hose clamp 12. The outlet 53 has a generally vertical portion 53*b* connected to a horizontal portion 53*c*. The horizontal portion 53*c* extends generally the length of the reservoir tank 50 and extends slightly below the bottom 50*b*. The reservoir tank 50 also includes an extension 54 which protrudes beyond the sidewall 50*c*. The protrusion 54 is a portion of the reservoir tank and the liquid product that is stored in the reservoir tank 50 is able to flow into the reservoir tank and the protrusion portion 54. The horizontal portion 53*c* of the outlet 53 allows for product to be removed from the reservoir tank 50 from the bottom of the reservoir tank. A second threaded opening 55 is formed in the top 50*a* of the reservoir tank 50. A reservoir float switch 56 has a cap 56*a* which is threaded on to the opening 55. Extending below the cap 56*a* is a float switch 56*b*. The float switch 56*b* extends into the reservoir tank 50 and floats in the product stored in the reservoir tank 50. The float switch 56*b* is electrically connected to a low-level lamp 22 by suitable means such as wires 57. This in turn is connected to a suitable power source by wires 58.

Figure 2:
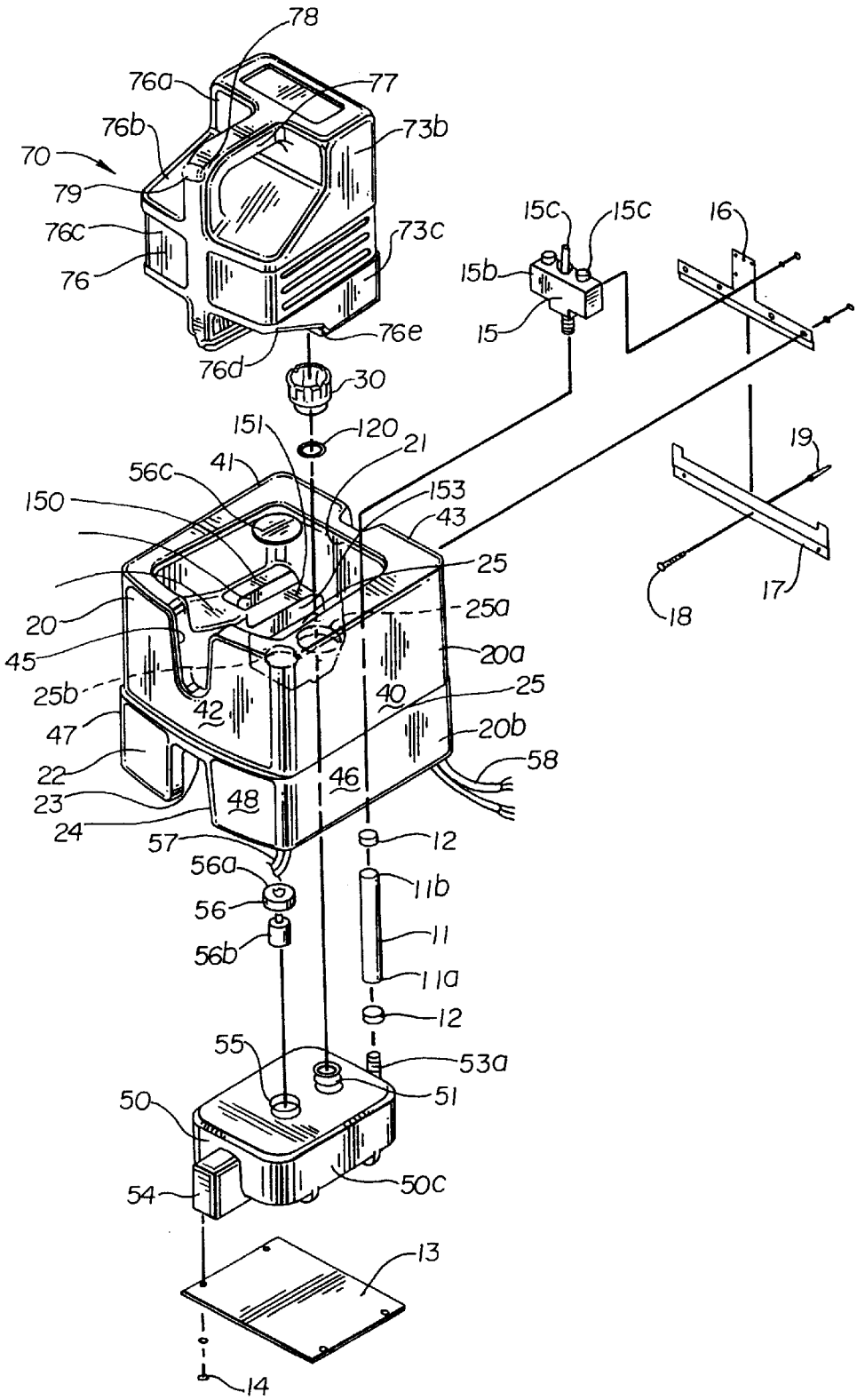
FIG. 2 is an exploded perspective view of the dispenser shown in FIG. 1.
Figure 15:
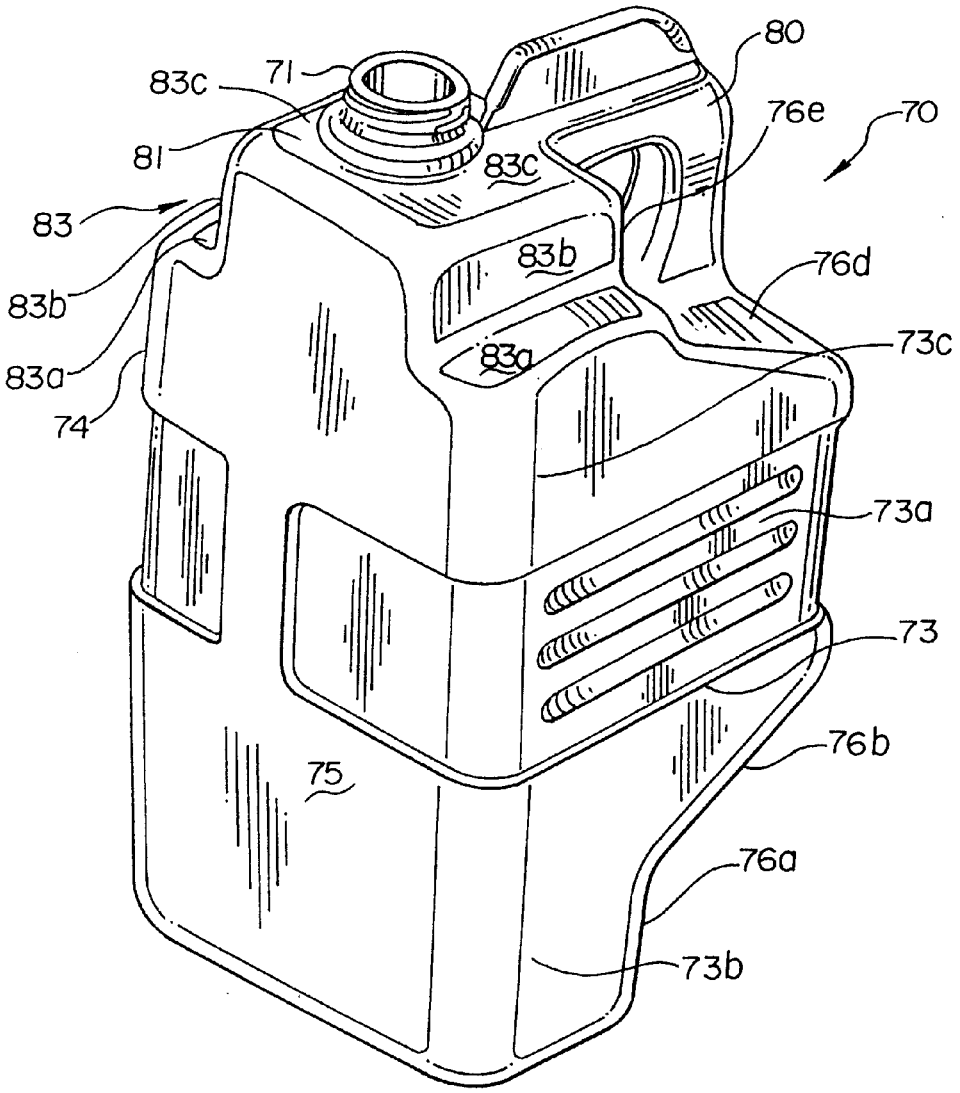
FIG. 15 is a perspective view of the container shown in FIG. 1.
Figure 17:
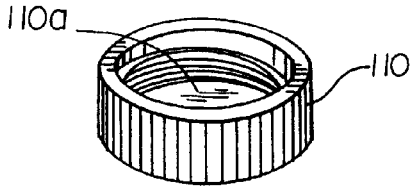
FIG. 17 is a perspective view of a cap for the container shown in FIG. 1.
Figure 16:
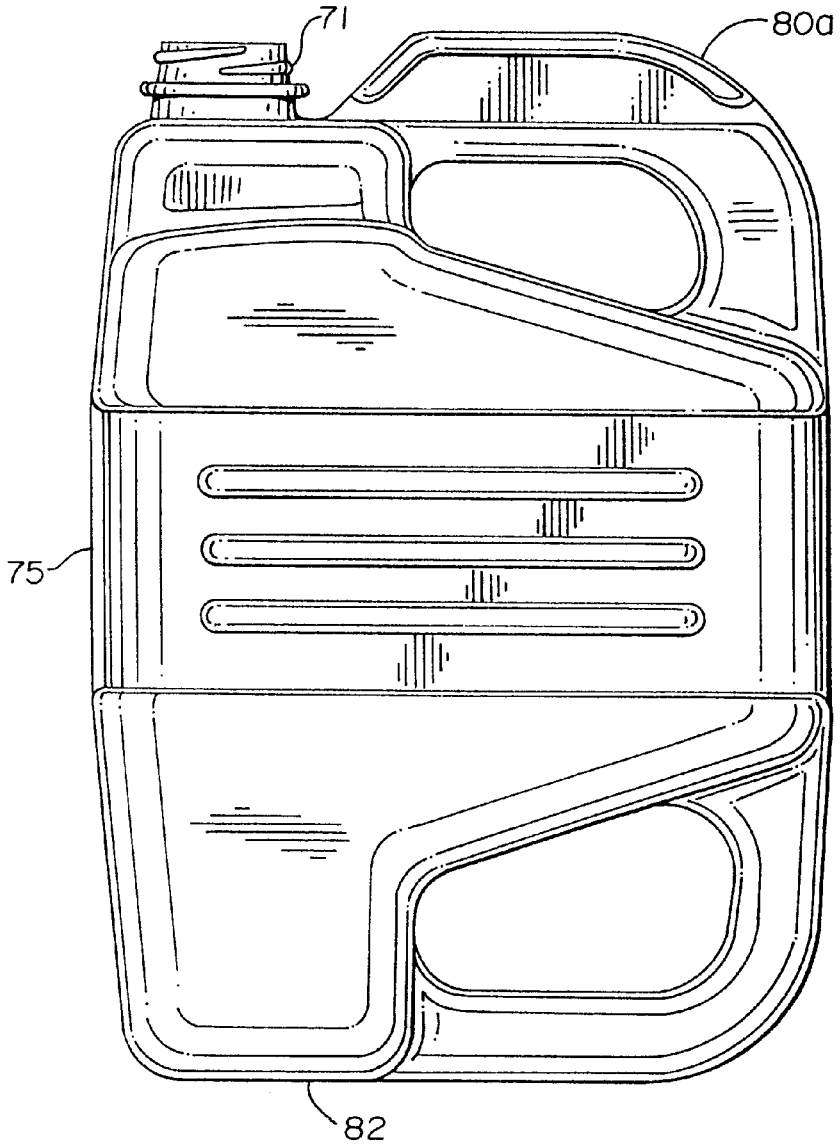
FIG. 16 is a side elevational view of the container shown in FIG. 1.

The docking station is shown in FIGS. 1, 2 and 15. The docking station 20 includes an upper section 20*a* and a bottom section 20*b*. The two sections are separated by a divider 25. The divider 25 forms the base of the upper section 20*a* and the top of the bottom section 20*b*. The upper section 20*a* has a right sidewall 40 connected to a left sidewall 41 by a front wall 42 and a rear wall 43. The walls 40–43 define an inner cavity 21. As will be described more fully hereinafter, the inner cavity 21 is sized and configured to receive the container 70. The inner cavity 21 has two sloped surfaces 44 which has a slot 45 formed between them. The divider 25 forms the bottom of the cavity 21. The two sloped surfaces 44 are proximate the front wall 42. The sloped surfaces 44 trends generally downward as they go towards the rear wall 43. Proximate the rear wall 43 is formed a mating indentation for the lockout feature of the container 70. The mating indentation is formed by a first generally horizontal surface 150 connected to a second horizontal surface 151 by wall 152. A second wall 153 connects the second horizontal surface 47 to the divider 25. A mirror image configuration is formed on the other side of the cavity to form the mating indentation proximate the docking cup 30.

The bottom section 20*b* is formed by right sidewall 46 and left sidewall 47 being operatively connected by the front wall 48 and rear wall 49. The walls 46–49 define a lower cavity 23 in which the reservoir tank 50 is positioned. The front wall 48 has an opening 24 formed therein for viewing the protrusion 54 of the reservoir tank 50. A first aperture 25*a* is formed in the divider 25 and provides a space for the inlet 51 to be positioned. A second aperture 25*b* is also formed in the divider 25 and provides an opening for the second threaded opening 55 and cap 56*a* to be positioned. A dust cover 56*c* is position over the cap 56*a*.

The reservoir tank 50 is positioned in the lower cavity 23 and is held in place by a base plate 13 and screws 14. The pickup tube's first end 11*a* is connected to the barbed end 53*a* by hose clamp 12, as previously described. The second end 11*b* of the pickup tube 11 is connected by a hose clamp 12 to an outlet manifold 15. The outlet manifold 15 is optional but does allow the product in the reservoir tank 50 to be dispensed to more than one location. The outlet manifold 15 has an inlet 15*a* which is connected to the manifold block 15*b*. A plurality of outlets 15*c* are provided which are in fluid communication with the inlet 15*a*. As shown in FIG. 2, several of the outlets are capped with a bolt, for when the outlets are not in use. The outlets 15*c* that are in use are connected to a suitable pump, such as a peristaltic pump or other suitable means of removing the liquid product from the reservoir 50.

The outlet manifold 15 may be secured to the back of the reservoir 20 by suitable means such as a mounting bracket 16 which may in turn by secured to a wall bracket 17. The wall bracket 17 is mounted on a wall by suitable means such as a screw 18 and toggle insert 19.

While the low level lamp will give an indication as to when the level of the liquid in the reservoir tank 50 is low, it is often advantageous for the operator to make a visual determination as to how much liquid product is left in the reservoir tank 50. Accordingly, the reservoir tank 50 has a protrusion 54 which extends into the opening 24. Since the protrusion 54 forms a part of the reservoir tank 50, the level in the reservoir tank 50 is the same as in the protrusion 54. Therefore, since the reservoir protrusion 54 is at the edge of the wall of the reservoir 20, the operator can visually see the amount of product left in the reservoir tank 50 by looking at the protrusion 54. The reservoir tank 50 will typically be made from a transparent plastic so that the liquid product is more easily seen by the operator.

Figure 5:
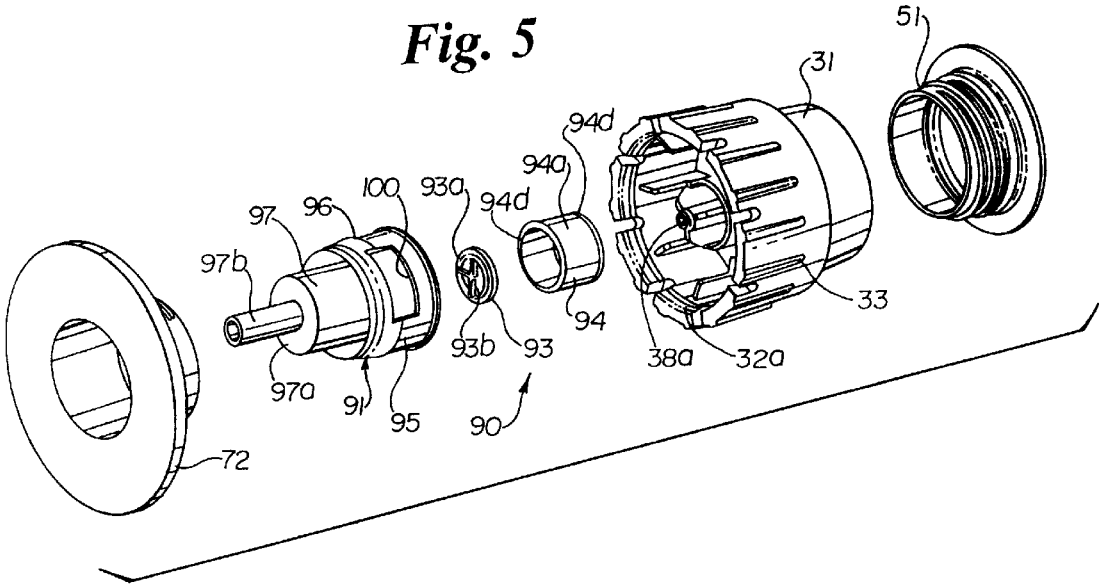
FIG. 5 is an exploded perspective view of a portion of the container, the bottle insert, docking cup and reservoir inlet of the dispensing system shown in FIG. 1.
Figure 8:
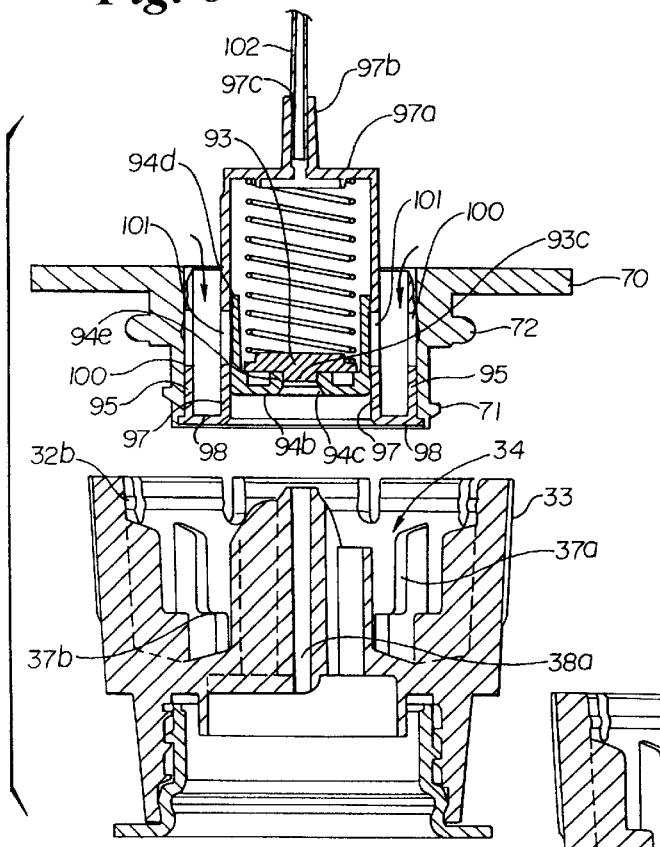
FIG. 8 is a cross-sectional view of the docking cup and insert shown in a fully closed position.
Figure 14:
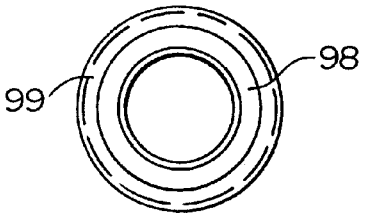
FIG. 14 is a bottom view of the bottle insert.

The container 70 has a threaded outlet 71. A circular lip 72 is formed around the outlet at the base of the threads. A bottle insert, generally designated at 90, is secured in the interior of the outlet 71. The bottle insert 90, as best seen in FIGS. 5 and 8, includes a first portion 91, a spring 92, cover 93 and slidable member 94. The exploded perspective view in FIG. 5 does not show the spring 92. However, the spring, as shown in FIG. 8, would appear between cover 93 and the first portion 91 as shown in FIG. 5. The first portion 91 includes a first outer member 95 that is generally cylindrical in shape. The outer diameter of the first outer member 95 is sized for a friction fit within the interior of the outlet 71. A sealing rib 96 extends around the outer member 95. A second inner member 97 is cylindrical in shape and is positioned inside of the first outer member 95. The ends of the first outer member 95 and second inner member 97 are connected by an annular ring 98. As shown in FIG. 14, a second annular ring 99 is operatively connected to the first annular ring 98. The annular ring 99 is very thin, approximately 0.010 inches thick. Further, the outer periphery of the second annular ring 99 extends beyond the outer periphery of the first annular ring 98 by approximately 0.020 inches. As will be described more fully hereinafter, the second annular ring 99 is a sacrificial material which is utilized in sealing the insert 90 to the container 70. Two slots 100 are formed in the outer member 95. The purpose of the slots 100 is to provide access to cut another set of slots 101 in the second inner member 97. The inner member 97 has a top 97*a*, a vent tube receptacle 97*b* is formed in the top 97*b*. The vent tube receptacle 97*b* has a central bore 97*c*. Preferably, the first portion 91 is formed as a single plastic piece, by means well known in the art.

The second inner member 97 has a central bore in which slidable member 94 is positioned. The slidable member 94 has a cylindrical side wall 94*a* operatively connected by a bottom 94*b*. The bottom 94*b* has an aperture 94*c* formed therein. Two sealing beads 94*d* are formed at the top and bottom of the sidewall 94*a*. The bottom 94*b* has a conical surface leading to the aperture 94*c*. A circular standoff ring 94*e* is formed on the interior of the bottom 94*b*. Preferably, the slidable member 94 is formed as a single plastic piece, by methods well known in the art.

The cover 93 is in the general shape of a disc. On one side is a strengthening circular member 93*a* with cross strengthening members 93*b*. A plug 93*c* is formed on the other side of the disc 93. The plug 93*c* is generally circular in shape and is sized to seal the aperture 94*c*. The cover 93 is seated on the standoff ring 94*e* as shown in FIG. 8. Unless a force is acting upon the plug 93*c*, this would be the typical closed position for the insert. The spring 92 is positioned between the top 97*a* and the cover 93 to force the cover against the bottom 94*b* of the slidable member 94.

Figure 11:
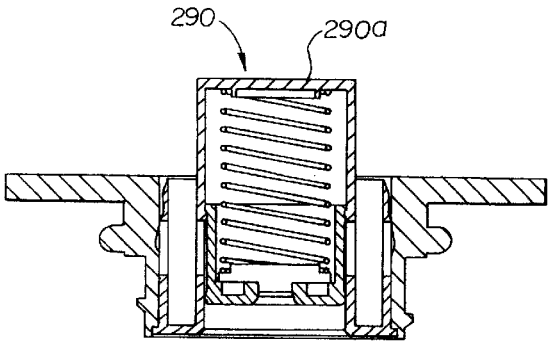
FIG. 11 is a side elevational view of a second embodiment of an insert.
Figure 13:
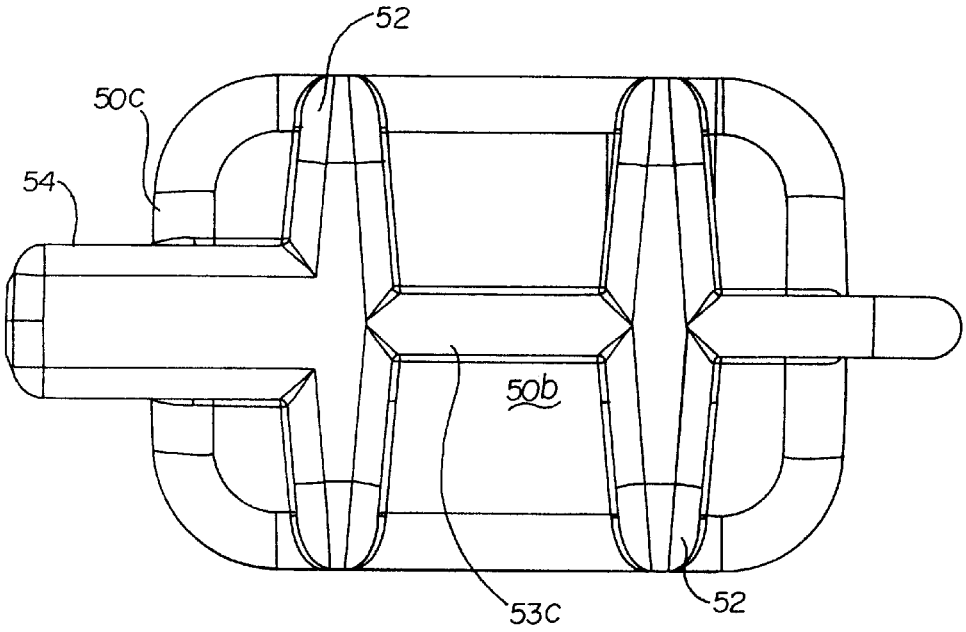
FIG. 13 is a bottom plan view of the reservoir shown in FIG. 12.
Figure 12:
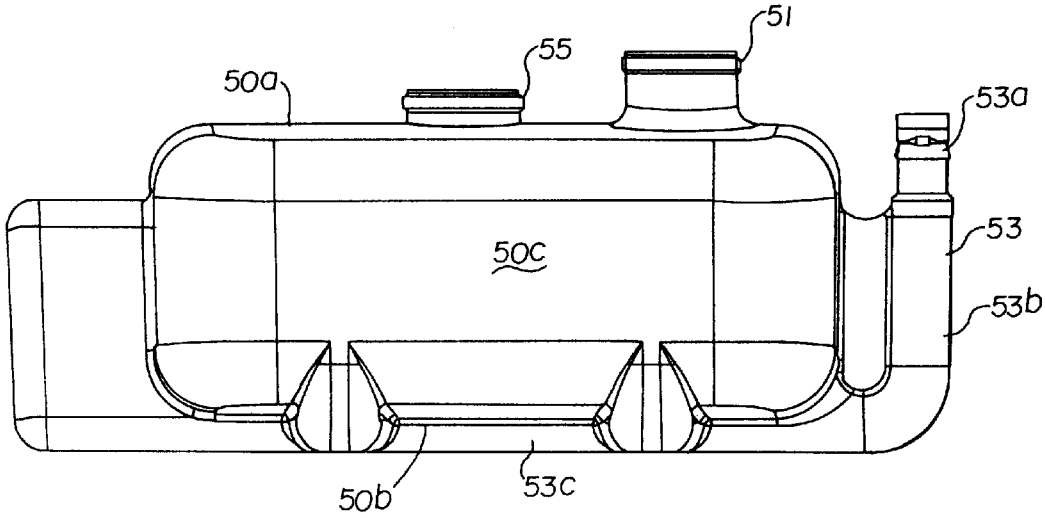
FIG. 12 is a side elevational view of the reservoir of the dispenser shown in FIG. 1.

A second embodiment 290 of the bottle insert is shown in FIG. 11. The only difference between the bottle insert 290 and the previously described bottle insert 90 is that the top 297*a* is solid and does not have an aperture formed therein.

The docking cup 30 is a generally cylindrically shaped member. The docking cup 30 includes a lower section 31 that is cylindrical and has an interior threaded portion 31*a*. The threaded portion is utilized to thread and secure the docking cup 30 to the inlet 51 of the reservoir 50. A gasket 120 is used to seal the inlet 51 to the docking cup 30. The upper section 32 is also cylindrical in shape and is sized slightly larger than the lower section 31. A lip 32*b* is formed proximate the top of the inner cavity 34 to form a snap fit with the container 70. A plurality of ribs 33 are provided to assist in gripping the docking cup 30 to make it easier to thread or unthread the docking cup 30 from the reservoir inlet 51. The upper section 32 defines a receiving cavity 34 which is sized to receive the outlet 71 of the container 70. A central cylinder 36 is connected to the bottom member 32*a*. The cylinder 36 has an outer sealing wall 36*a*. The central bore 35, formed by the cylinder 36, extends through the upper section 32 and is in fluid communication with the inner cavity 31*b* of the lower section. The inner cavity 31*b* is in fluid communication with the reservoir 50. A plurality of L-shaped flanges 37 are formed on the inner wall of the upper section 32. The L-shaped flanges have a side surface 37*a* and a bottom surface 37*b*. The side surface 37*a* is angled such that the top of the surface 37*a* is farther away from the longitudinal axis of the docking cup 30 than is the bottom of the side surface 37*a*, proximate the bottom 37*b*. Therefore, as the outlet 71 of the container 70 is inserted into the docking cup, the side surface 37*a* is used as a guide to center the outlet 71 over the docking cup 30. The flanges 37 allow for the positioning of the container 70 as it is inserted into the docking cup 30. Further, the bottom of 37*b* of the flanges 37 define a rim to stop the container 70 from being inserted further.

A central vent pipe 38 is positioned in the center of the cylinder 36 and is held in place by means of three connecting members 39. The connecting members 39 simply connect the central vent pipe 38 and position it inside of the central bore 35 without closing off flow of product through the bore 35. The central vent pipe 38 has a bore 38*a* which extends all the way through and is open to the inner cavity 31*b* of the lower section 31. A non-functional vent pipe 41 is formed at the bottom of the central vent pipe 38 and extends generally 90° from the central vent pipe 38 to the outer edge of the docking cup 30. As viewed in FIG. 3, only the outer semicircular wall of the vent pipe 41 is shown. There is no actual venting which is accomplished by use of the vent pipe 41 in the present embodiment. An operational vent pipe 41 will be discussed more fully with respect to second and third embodiments of the docking cup 30.

Figure 3:
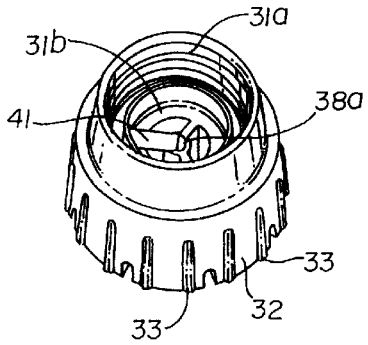
FIG. 3 is a perspective view, viewed generally from below, of the docking cup of the dispenser shown in FIG. 1.
Figure 4:
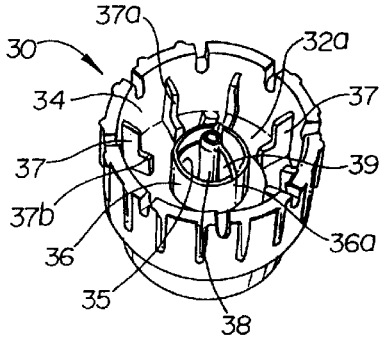
FIG. 4 is a perspective view, taken generally from above, of the docking cup shown in FIG. 3.
Figure 6:
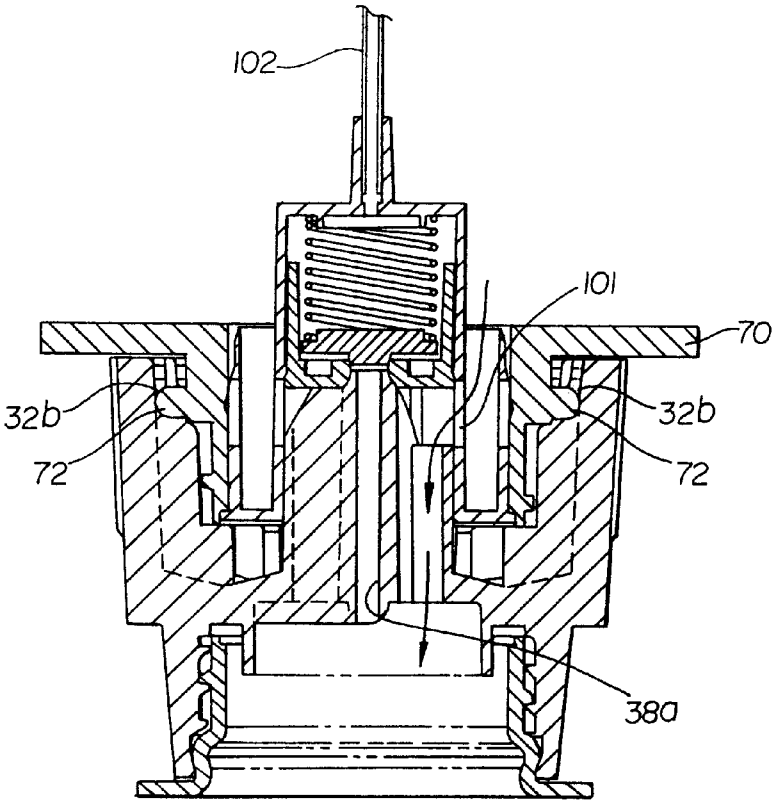
FIG. 6 is a cross-sectional view of the docking cup and bottle insert, shown in a fully open position.
Figure 9:
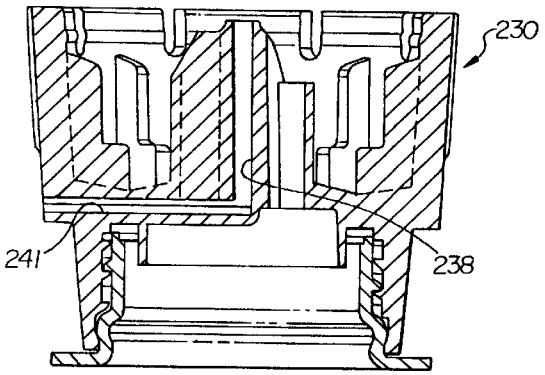
FIG. 9 is a cross-sectional view of a second embodiment of a docking cup and second embodiment of a bottle insert, shown in a fully open position.
Figure 10:
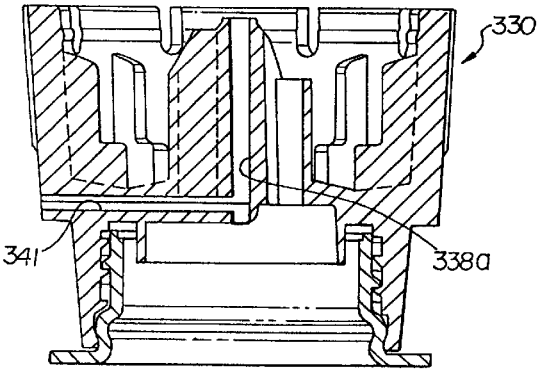
FIG. 10 is a cross-sectional view of a third embodiment of a docking cup.

A second embodiment of a docking cup 230 is shown in FIG. 9 and a third embodiment 330 is shown in FIG. 10. The second embodiment 230 is similar to the first embodiment 30 except for the venting provided. Accordingly, only the differences will be discussed, the remaining portions of the cups 230 and 330 being similar to the cup 30. As shown in FIG. 6, the center bore 38*a* extends all of the way through to the inner cavity 31*b* of the lower section 31. However, in the second embodiment, the bore 238 is closed at its bottom and does not vent into the inner cavity. Further, the vent pipe 41, as seen in FIG. 3, is non-operational. However, in the second embodiment, the vent pipe 241 is bored out and extends from the center bore 238 to the outside of the docking cup 230.

The third embodiment of the docking cup 330 is shown in FIG. 10. The vent 341 is bored out, similar to that in the docking cup of the second embodiment 230. However, the center bore 338*a* is again open to the lower section's inner cavity, similar to the first embodiment. The docking cup is preferably a single plastic piece, made by methods well known in the art.

The container 70 may be formed by any suitable process such as blow molding. The container 70 is a dual-handled container. The container 70 has two sidewalls 73 and 74 that are mirror images of each other. The sidewalls have a central section 73*a*, upper section 73*b* and lower section 73*c*. The upper and lower sections 73*b* and 73*c* extend upward and downward respectively from the back of the sidewalls. A generally rectangular back wall 75 connects the back of the sidewalls 73 and 74. The front wall 76 has a first generally vertical section 76*a* connected to a sloped section 76*b* which is in turn connected to a horizontal section 76*c*. The horizontal section 76*c* is connected to a sloped surface 76*d* which is in turn connected to a generally vertical section 76*e*. The front walls 76 connects the front end of the sidewalls 73 and 74. A first handle 77 is formed at one end of the container 70. The handle 77 has one end connected to the front wall 76*a* and the other end connected to the front wall 76*b*. A vent 78 is formed in the handle 77 and is closed with a cap 79. The vent 78 is preferably a hole that is covered with a foil liner that may be removable. The cap 79 then screws over the vent 78 such that when the vent is desired, the cap 79 is removed and then the foil is pierced or removed exposing the hole formed in the vent which are in fluid communication with the inner cavity of the container 70. A second handle 80 is connected between the front wall 76*d* and front wall 76*e*. A threaded outlet 71 is formed top 81. The outlet 71 has threads on the outside on which a cap 110 is secured. The container also has a bottom 82 which is connected between the upper sections 73*b* and 74*b*. It should be appreciated that reference to the top 82 and bottom 81 is relative depending upon which way the container is turned. The second handle 80 has an extension 80*a* which is solid and extends beyond the end of the outlet 71. This provides protection in case the bottle is dropped when being held by the first handle.

Proximate the outlet 71 is formed a lockout feature 83. The lockout feature 83 is sized to mate with the mating indentation formed in the docking station 20. The lockout feature 83 includes a first horizontal section 83*a* connected to a second horizontal section 83*b* by vertical section 83*c*. A mirror image configuration is formed on the other side of the outlet cup. Section 83*a* will come to rest on horizontal surface 150 and section 83*b* will rest on horizontal section 151. The width and length of the lockout feature match the width and length of the mating indentation. The sloped surface 76*d* rests on the sloped surface 44 when the container 70 is inserted in the docking station 20.

Figure 18:
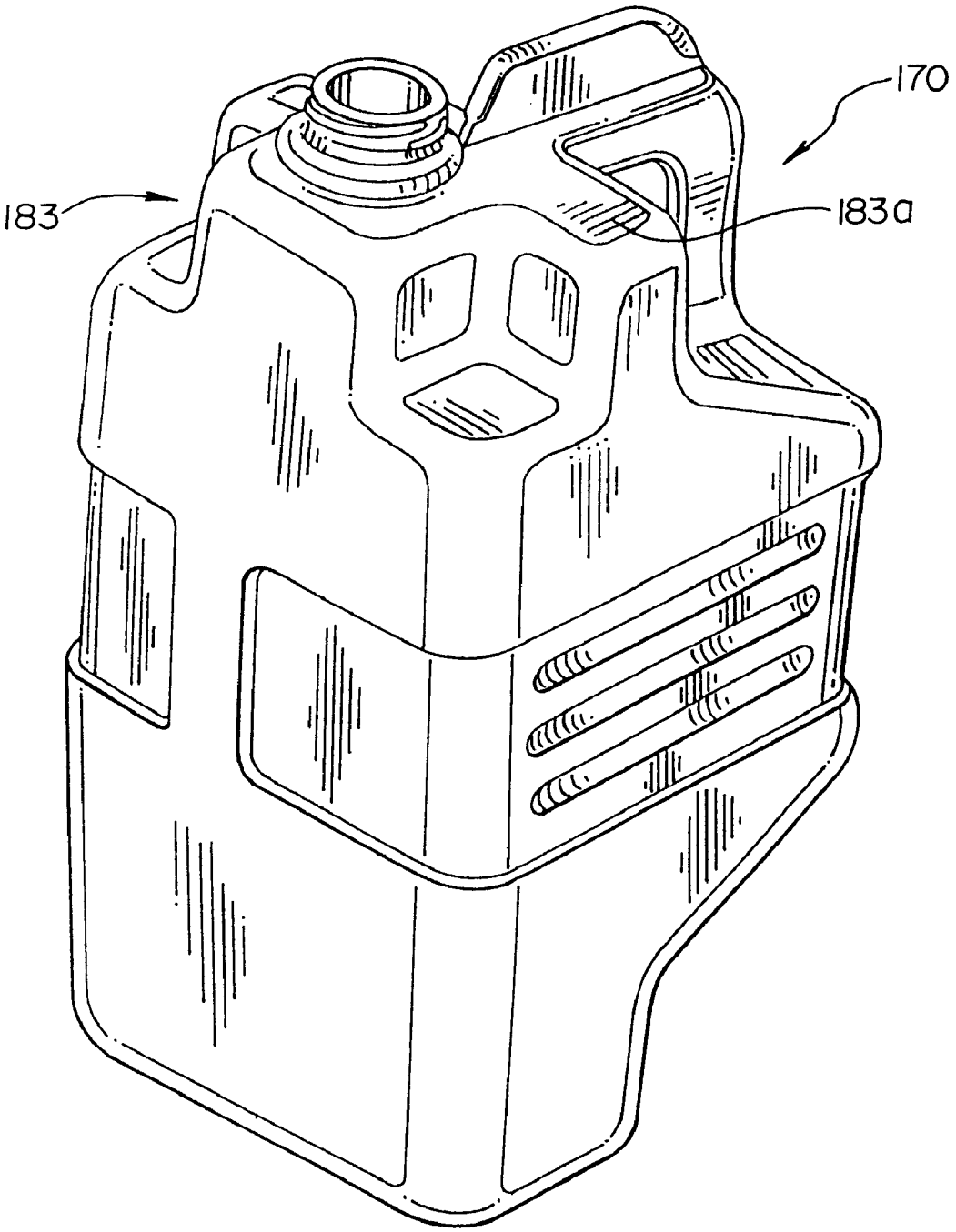
FIG. 18 is a second embodiment of a container.
Figure 19:
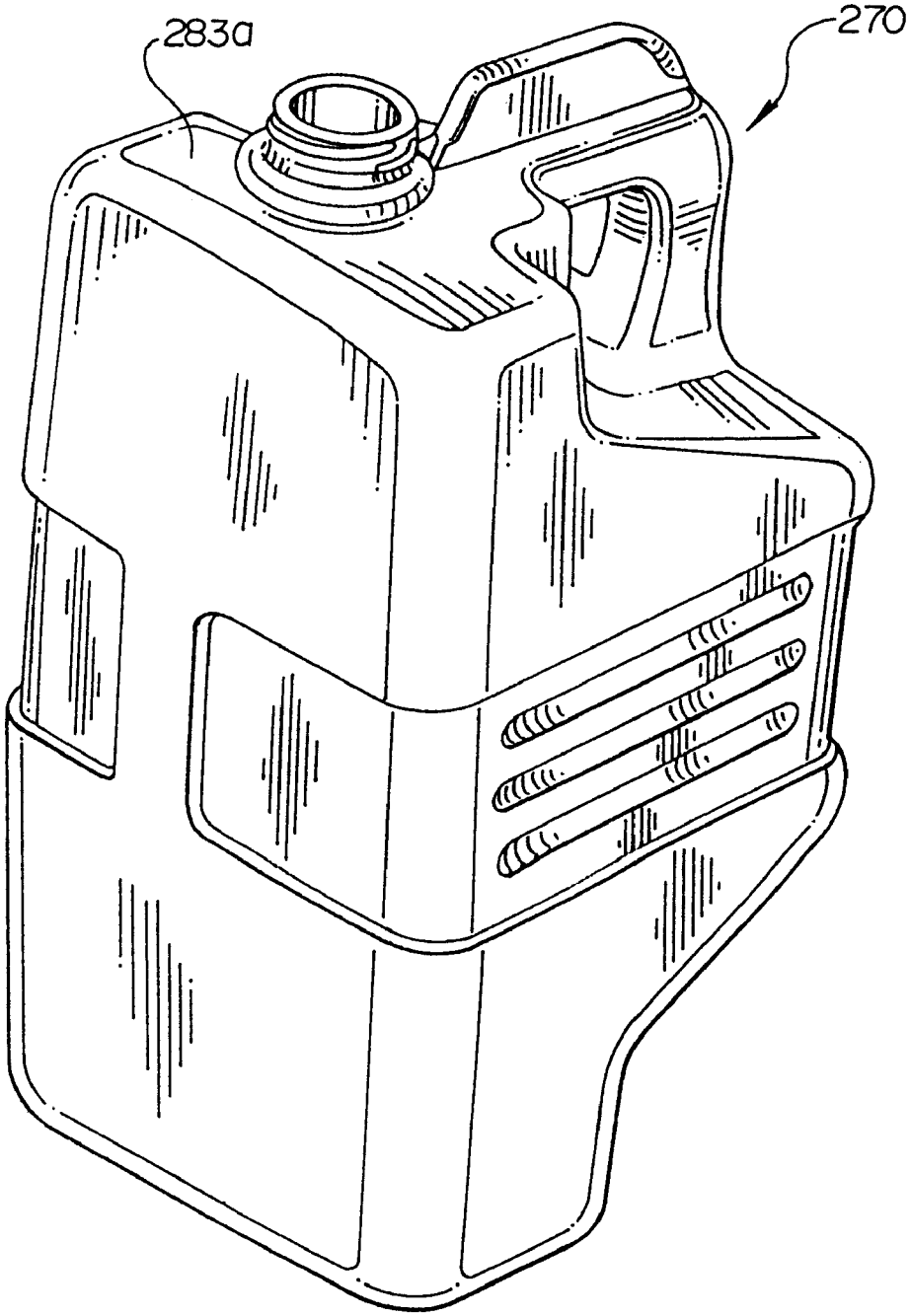
FIG. 19 is a third embodiment of a container.

FIGS. 18 and 19 show alternative embodiments of the container 70. The second embodiment 170 and the third embodiment 270 are identical to the first container 70 with the exception of the lockout features of the second and third embodiments.

Referring to FIG. 18, the lockout feature 183 is sized and configured such that it does not fit into the mating indentation in the reservoir 20. For example, the cross member 183*a* is positioned so that if inserted into the reservoir 20 the cross member 183*a* would hit on the surfaces 150 and not allow the container 170 to fit into the reservoir 20. In order to utilize the container 170, another reservoir (not shown) would have a mating indentation that would match that of the lockout 183. Therefore, the product contained in container 170 would only be able to be dispensed in a reservoir specifically having a mating indentation to match the lockout feature 183.

Similarly, FIG. 19 shows still another embodiment of a container 270 having a lockout features 283. The configuration shown in FIG. 19 is such that it does not fit into the mating indentation of the reservoir 20 nor that of a reservoir which would be constructed for the container 170. The cross member 283*a* is wider than lockout feature 83 and will therefore not fit in the mating indentation of reservoir 20. Also, it is at the edge of the container 270, as opposed to being set back, as is cross member 183*a* of container 170. Still another reservoir (not shown) would be constructed having a mating indentation which would match that of the lockout feature 283. The lockout features and mating indentations are sized and configured to be mutually exclusive so as to prevent the dispensing of a wrong product through an inappropriate reservoir. In such a manner, the operator will only be able to dispense a given product from a given reservoir. Therefore, the wrong product cannot be dispensed from the wrong reservoir as the mating indentation and lockout features are mutually exclusive and prevent the containers from properly seating in the docking cup 30 unless the correct container has been matched to the correct reservoir.

In order to obtain plastic on plastic seals, the dispensing system 10 utilizes a variety of plastics having different hardnesses. The docking cup 30 is formed of a first hardness. The slidable member 94 is formed from a second material less rigid than the material for the docking cup. Still further, the sealing cover 93 is formed from a third material less rigid than the second material. The difference in rigidity allows for the plastic on plastic seals. In a preferred embodiment, the docking cup 30 is formed from polypropylene, the slidable member 94 from high-density polyethylene and the cover 93 from low-density polyethylene.

In assembling the bottle insert 90 for use, the spring 92 is placed inside of the inner member 97. The cover 93 is then placed inside of the slidable member 94 which is inserted inside of the second inner member 97. The two sealing beads 94*d* are sized slightly larger than the bore of the second inner member 97 thereby causing a seal as it is pushed inside. However, they are not sized so much greater as to prevent the sliding member 94 from sliding inside of the bore of the inner member 97. The bottle insert is then placed inside of the inlet 71. The bottle insert 90 is sized to form a friction fit with the opening of the inlet 71. However, because the container is typically blow molded, tolerances are hard to control to get a liquid tight seal. Accordingly, applicants use the sacrificial material in the annular ring 99 to seal the bottle insert 90 inside of the outlet 71. A screw cap 110 has a foil liner 110*a*. The threaded cap 110 is threaded onto the outlet 71. Induction heating is then applied, by means well known in the art, and the sacrificial material 99 melts and forms a seal to prevent any leakage around the insert 90 and the outlet 71. It is important that the amount of sacrificial material be limited so that it does not flow too far inward and fuse the slideable member 94 to the annular ring 98.

The container 70 may also be formed without a vent 78 formed in the first handle 77.

In use, the liquid dispensing system 10 provides for safe and easy-to-use liquid product storage and application. The container 70 is shipped in boxes with the outlet 71 facing upward. The container 70, in this position, is easily handled by grasping the first handle 77. When the product inside of the container 70 is needed for the liquid dispensing system 10, the first handle 77 is grasped to lift out the container 70. Then, the cap 110 is removed. Then, the container is inverted for use in the liquid dispensing system 10. Upon inverting, the second handle 80 is used to grasp the container 70. The container 70, with the outlet 71 pointing downward, is then brought to the docking station 20. The container 70 is positioned over the docking cup 30 and low(red into position. The lockout feature of the container has to match with the lockout indentation of the reservoir in order for the outlet 71 to come into contact with the docking cup 30. The use of different lockout shapes can be utilized to prevent the dispensing of wrong product in a liquid dispensing system. The product and reservoir may also be color-coded to provide another level of identification of the correct product.

Figure 7:
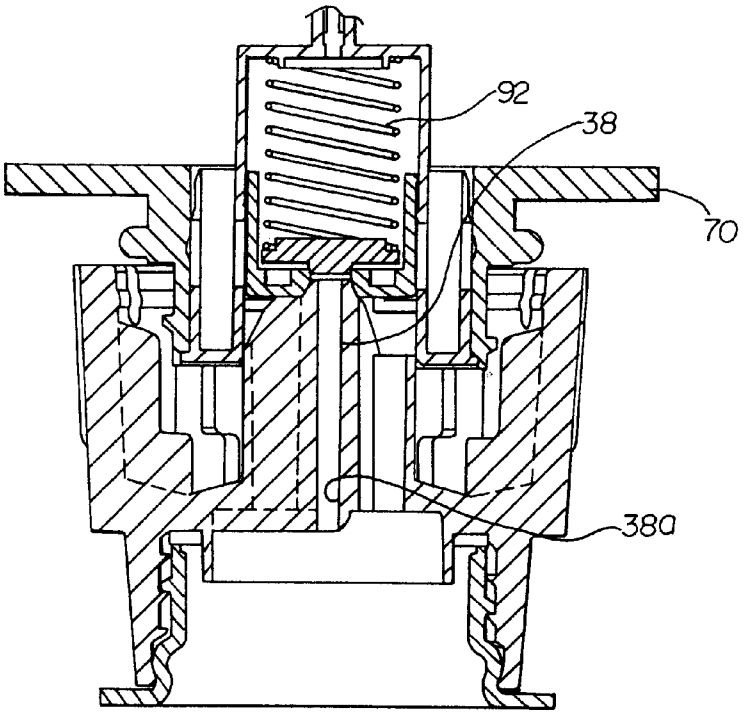
FIG. 7 is a cross-sectional view of the docking cup and insert shown in a half-engaged position.

The sequence of steps in inserting the container 70 into the docking cup 30 is shown in FIGS. 6 through 8. The position shown in FIG. 8 is that of the container 70 just prior to contacting the docking cup 30. In this position, the spring 92 is pushing the cover 93 against the aperture 94*c*. In addition, the slidable member 94 is in a position which covers the slots 101. The arrows in FIG. 8 show the position of the product flow inside of the container 70. However, because the slidable member 94 is covering the slots 101, the product is not able to flow outside of the container 70.

Then, moving to FIG. 7, the top of the central vent pipe 38 contacts the cover 93, through the aperture 94*c*, and moves it away from the aperture 94*c*. This allows air to enter into the chamber carrying the spring 92. However, there is a shoulder on the vent pipe 38 which prevents the vent pipe 38 from entering the spring chamber. The vent pipe only lifts the cover 93 off of the aperture 94*c* and then is stopped from moving further inward by the shoulder. At that point, further movement of the container 70 towards the docking cup 30 causes the vent pipe 38 to move the slidable member 94 upward inside of the second inner member 97. By venting the spring chamber 92, the slidable member is able to be moved further into the inner member 97 as shown in FIG. 6.

Further, venting allows the spring to return fully to the position shown in FIG. 8 when the container 70 is removed.

As shown in FIG. 6, the container 70 is locked into the docking cup 30 by the lip 72 of the container 70 slipping past the lip 32*b*. This forms a snap fit between the lip 72 and the lip 32*b*. In the position shown in FIG. 6, the slidable member 94 is forced still further up into the chamber in which the spring 92 is located. In doing so, the slidable member 94 moves past the slot 101. This allows product to flow (as shown by the arrows in FIG. 6) from the container 70 through the slot 101 and into the inner cavity 31*b* of the lower section 31. The lower section 31 is in fluid communication with the reservoir 50 and therefore product is dispensed into the reservoir tank 50. If a snap fit or other retaining means between the container 70 and docking cup 30 were not used, the spring 92 would tend to push the container 70 away from the docking cup as product was dispensed. At some point, the weight of the product would not be sufficient to overcome the biasing force of the spring and the container would move off of the docking cup 30. The snap fit between the docking cup and the container prevents this from occurring.

The present invention is usable in three different configurations to vent a plurality of viscous liquids. The configuration just described with respect to FIGS. 6 through 8 describes using the docking cup 30 which has the vent pipe 38*a* open at the bottom. A vent tube 102 is positioned in the bore 97*c*. The vent tube 102 extends up into the container to proximate the top of the container. Further, an exterior vent 78 is utilized. This allows for highly viscous product to be dispensed.

In another embodiment, the external vent 78 is utilized in the container 70, however, no vent tube is needed. In this particular embodiment, the second bottle insert 290 would be used and the second embodiment 230 docking cup would be utilized. This is for low viscosity product.

Still another embodiment of the invention is to use no external vent on the container 70. However, a vent tube is utilized so the first embodiment of the bottle insert 90 would be used. The third embodiment is to use an external vent 78 on the container. No vent tube is utilized so the second embodiment 290 of the insert is used. The third embodiment 330 of the docking cup is utilized. This is utilized for low viscosity product that off gas.

By the use of the various combinations of the three docking cups with different bottle inserts, a wide variety of products can effectively be dispensed while three different venting structures have been described in detail, it is understood that other venting alternatives fall within the scope of this invention.

A peristaltic pump or other suitable pump is then utilized to pump out the product from the reservoir 50 through the outlet manifold 15 to the appropriate end use machine. The product manifold 15 has three different outlets so that three different end use machines may be connected to the dispenser 10.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A liquid dispensing apparatus, comprising:

a) a container for holding a liquid product to be dispensed, the container having an outlet at a first end and the container having a second end;

b) a docking station for receiving the container; the docking station having a support for holding the container;

c) a reservoir tank for receiving liquid product from the container, the reservoir tank having an inlet and an outlet;

d) a docking cup operatively connected to the docking station, the docking cup having an inlet adapted to receive the outlet of the container, and the docking cup having an outlet operatively connected to the inlet of the reservoir; and e) the container having a first handle positioned proximate the first end for initial handling of the container and a second handle positioned proximate the second end for handling the container while it is inserted in the docking station.

2. The dispensing apparatus of claim 1, further comprising a low-level alarm operatively connected to the reservoir tank whereby a low level of liquid product is detectable.

3. The dispensing apparatus of claim 1 further comprising:

a) the container having a lock-out section formed proximate the outlet of the container; and b) the docking station having a mating lock-out indentation proximate the docking cup, wherein the lock-out section and lock-out indentation restrict access to the docking cup.

4. The dispenser of claim 3, wherein the first handle has an extension member that extends beyond the outlet of the container, wherein when held by the second handle and the container is dropped, the extension member protects the outlet of the container from damage.

5. The dispensing apparatus of claim 4, wherein the docking station has a lower section, said lower section forming a cavity in which the reservoir tank is positioned, the lower section having an opening through which the reservoir may be seen and the liquid product seen.

6. The dispensing apparatus of claim 5, further comprising the reservoir tank having a top and a bottom and the outlet of the reservoir is positioned proximate the bottom.

* * * * *